US006030273A

United States Patent [19]

Hsu

[11] Patent Number: 6,030,273

[45] Date of Patent: Feb. 29, 2000

[54] REVOLVING DEVICE FOR A WATER GLOBE

[76] Inventor: Shun-Hsi Hsu, 17 Lane 99 Psei Yuan Street, Tainan, Taiwan

[21] Appl. No.: 08/994,493

[22] Filed: Dec. 19, 1997

[51] Int. Cl.[7] ..... A63H 3/52

[52] U.S. Cl. ..... 446/267; 446/268

[58] Field of Search ..... 40/410; 446/267, 446/268

[56] References Cited

U.S. PATENT DOCUMENTS

| | | | |
|---|---|---|---|
| 5,092,065 | 3/1992 | Teng | 40/410 |
| 5,110,636 | 5/1992 | Hou | 40/410 X |
| 5,286,535 | 2/1994 | Hou | 446/267 X |
| 5,555,656 | 9/1996 | Liu | 40/410 X |
| 5,666,750 | 9/1997 | Segan et al. | 40/410 |
| 5,729,923 | 3/1998 | Lin | 40/410 X |
| 5,732,492 | 3/1998 | Lin | 40/410 |
| 5,864,976 | 2/1999 | Yang | 40/410 |
| 5,875,577 | 3/1999 | Lu | 40/410 X |
| 5,878,515 | 3/1999 | Yang | 40/410 X |

*Primary Examiner*—Sam Rimell
*Attorney, Agent, or Firm*—Ladas & Parry

[57] ABSTRACT

A watertight revolving device for rotating an ornamental object within a water globe that includes a base and a glass dome. The ornamental object has a vertical shaft extending down through a sealing gasket, through a rubber plug, and bent into a notch in a first coupling member. The first coupling member has holes for receiving upright bars of a second coupling member to fit therein. The first coupling member is attached to the rotatable ornamental object, and the second coupling member is attached to a revolving musical movement. The rubber plug has its annular wall provided with an annular projection, or rib, to engage the inner surface of a glass dome projection. The sealing gasket and rubber plug ensure a secure structure for preventing water from leaking out of the glass dome. One or more annular hard plastic members may be provided to reduce rotational sliding friction between the revolving and stationary components.

11 Claims, 3 Drawing Sheets

REVOLVING DEVICE FOR A WATER GLOBE

BACKGROUND OF THE INVENTION

1. Field of the Invention

This invention relates to a revolving assembly within a water globe. More particularly, it allows a simple revolving assembly within a water globe to be water and air tight.

2. Brief Description of the Prior Art

Conventional revolving assemblies are complicated and are also prone to water leakage. Water leakage in prior art water globes results from a lack of attention given to the physical characteristics of the rotational shaft and water seal arrangement. A typical prior art water globe, housing a rotational object within the globe, has a plastic shaft passing through an O-ring sealing member which may be easily dislodged and cause leaking. Due to the natural weakness of plastic, the rotating shaft must have a diameter sufficient to support the rotational object without bending or breaking. However, a large diameter shaft encounters strong frictional resistance due to the large area of shaft-to-seal contact. Consequently, the rotation of the shaft causes accelerated wear leading to premature leakage problems, and rotation may be uneven and may stutter, given the limited rotational force used to power the shaft as would be provided by a music box spring mechanism.

As a result, such prior art water globes are subject to leaking with obvious disastrous consequences.

SUMMARY OF THE INVENTION

The present invention provides a simple revolving ornament assembly providing an air and water tight structure between the rotatable shaft and an annular flexible plug and a sealing gasket.

In a preferred embodiment of the invention, there is provided a water globe housing, a revolving ornamental object having a shaft, the shaft extending through a sealing gasket, through a flexible rubber plug, and through a first coupling, and then bent to engage in a notch of the first coupling. The first coupling has openings for receiving upright bars of a second coupling, and the second coupling is attached to and rotates with a revolving musical movement. As the musical movement revolves, the ornamental figuring revolves within the globe. In addition, the flexible rubber plug has an annular extension wall provided with an outwardly directed annular projection, or rib, to engage the inner surface of an annular extension of a glass dome to effect a secure and air/water tight plug-to-globe seal. The annular plug may be made of a flexible material other than rubber.

The construction of the invention is such that assembly of the component parts is relatively easy and simple, yet the completed assembly is air and water tight. In a preferred embodiment of the invention, the shaft for the rotating ornamental figurine is made of steel which, compared to plastic, has a very small degree of expansion and shrinkage. Additionally, the invention incorporates a double-sealing arrangement for the rotating shaft, and the combination of the double-sealing arrangement and steel shaft prevents water leakage.

In one embodiment of the invention, an additional annular plastic member may be employed to reduce the friction between the rotational and stationary parts of the assembly.

The revolving base portion of the ornamental figurine has a hole in it that allows air to release to the outside, thus preventing air bubbles from entering the globe.

BRIEF DESCRIPTION OF THE DRAWING

These and other aspects of the invention will be better understood, and additional features of the invention will be described hereinafter having reference to the accompanying drawings in which.

DETAILED DESCRIPTION OF THE PREFERRED EMBODIMENTS

Figure 1:
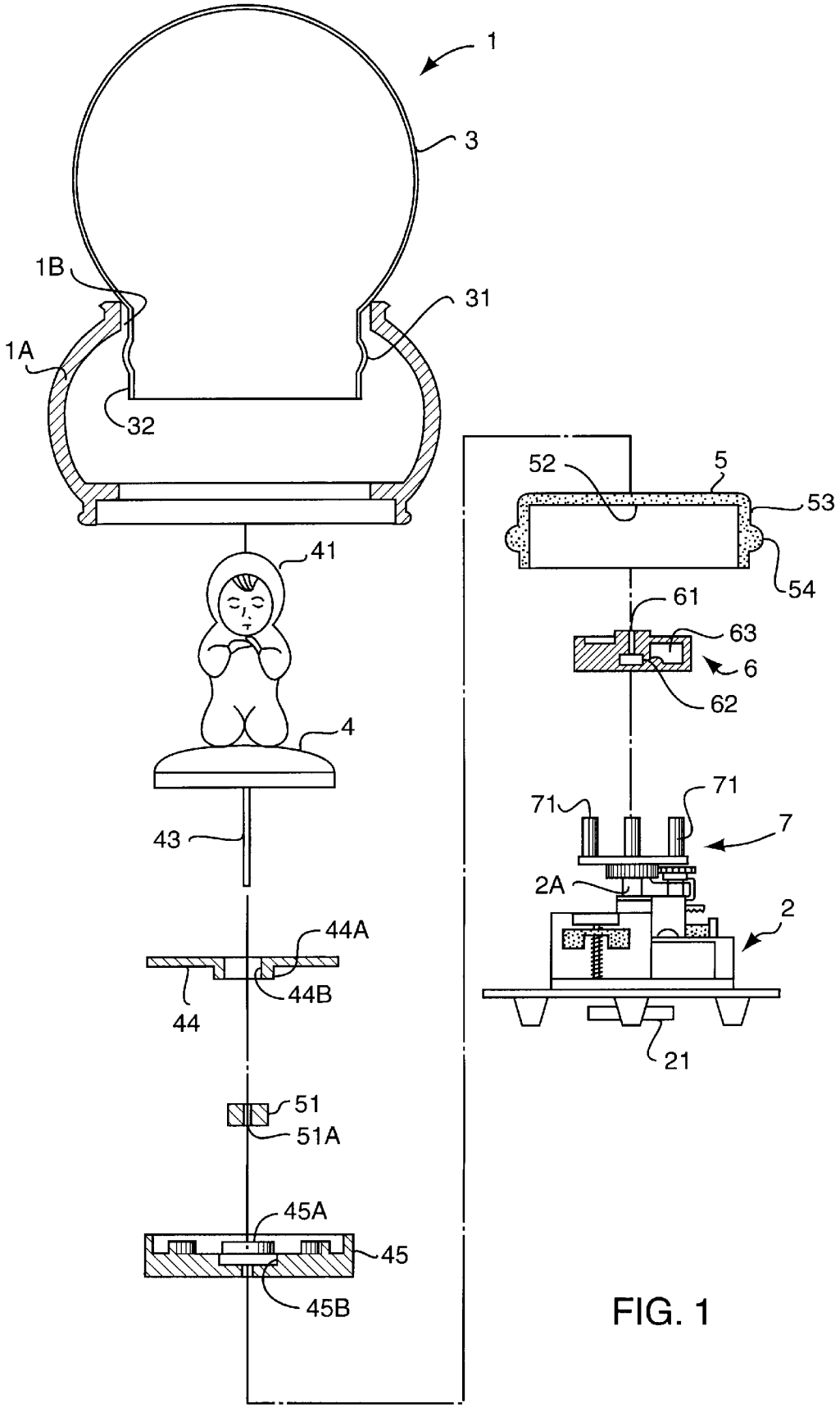
FIG. 1 is an exploded partial cross-sectional view of the components making up a completed water globe including a revolving device for rotating an interior figurine within the water globe.
Figure 2:
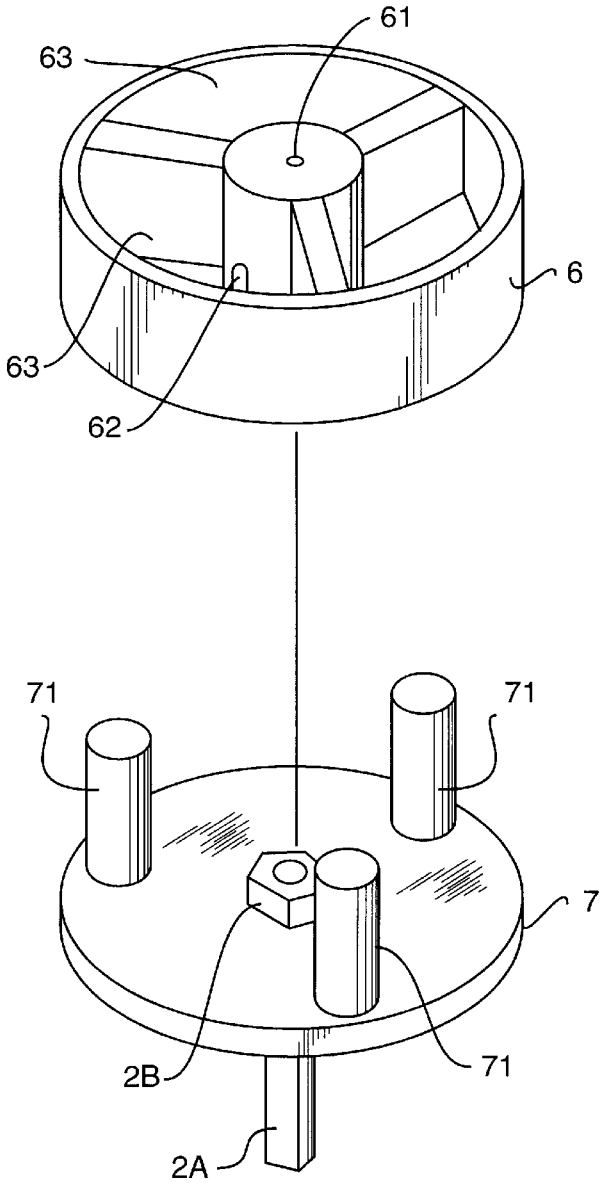
FIG. 2 is a perspective view of a pair of coupling members which engage to couple the musical movement to the revolving figurine.
Figure 5:
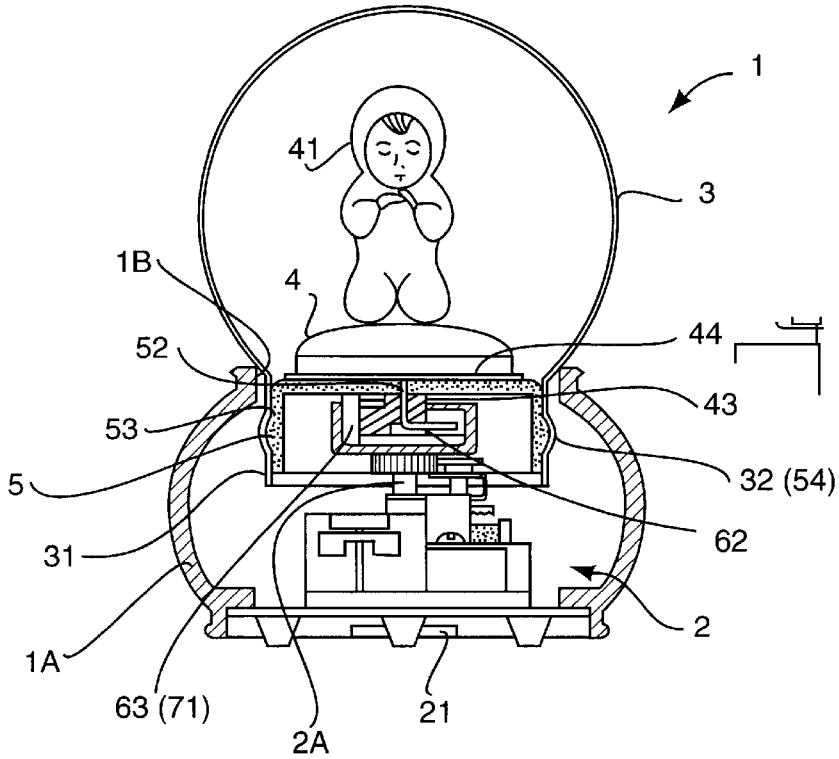
FIG. 5 is a partial cross-sectional view of one embodiment of the invention using the plastic plate of FIG. 3 but without the plastic tray of FIG. 4.

FIGS. 1, 2, and 5 show water globe 1 comprising a globe base 1A supporting a glass dome 3, a revolving musical movement 2 disposed in the globe base 1A, a revolving figurine base 4 with an ornamental figurine 41 fixed thereon disposed in the glass dome 3, a rubber plug 5, a first coupling 6, and a second coupling 7.

The base 1A of water globe 1 has an upper mouth 1B for receiving the bottom 31 of the glass dome 3.

The revolving musical movement 2 has a winding key 21 located under the bottom of the water globe base 1A, and the upper output shaft 2A of the musical movement 2 is fixed, as by a screw or nut 2B for example, to the bottom of second coupling 7.

The revolving musical movement 2 may be selected from a variety of available types, such as musical movement No. 37101 available from the Woodworkers' Store, 4365 Willow Drive, Medina, Minn. 55304. Since musical movements of this type are well known in the art, details of their operation are unnecessary in this description.

The revolving base 4 has ornamental figurine 41 formed integrally on its upper side and is located in the interior of the glass dome 3, with the ornamental figurine 41 viewable from outside of the glass dome 3.

Figure 3:
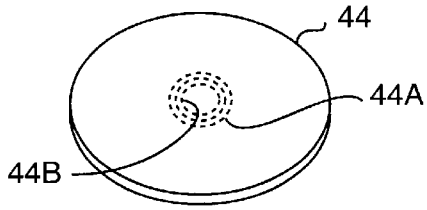
FIG. 3 is a perspective view of the bottom side of a plastic plate upon which the revolving figurine is disposed.
Figure 4:
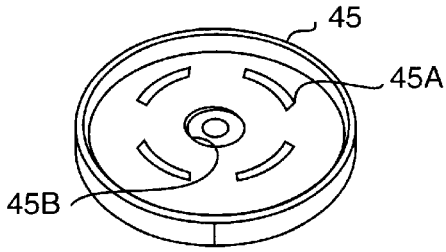
FIG. 4 is a perspective view of an optional plastic tray cooperating with the plastic plate of FIG. 3 to provide low frictional resistance to rotation.

Having further reference to FIGS. 3 and 4, the revolving base 4 has a vertical shaft 43 extending down to pass through a central opening in round plastic plate 44 and plastic tray 45 (FIGS. 1, 3, and 4). FIG. 3 is a bottom view of plastic plate 44 to show the depending flange 44A. The plastic plate 44 and plastic tray 45 combination is located between the revolving base 4 and the rubber plug 5 to reduce friction between the revolving base 4 and the rubber plug 5, allowing the revolving base 4 to revolve smoothly.

Plastic plate 44 is glued, or otherwise attached, to the bottom of revolving base 4, and plastic tray 45 is glued, or otherwise attached, to the top of rubber plug 5. If glued, the preferred glue is a strong super-glue adhesive.

Plastic tray 45 has a series of spaced raised projecting ribs 45A upon which the lower surface of plastic plate 44 slidably contacts. The depending flange 44A of plastic plate 44 is positioned to seat into a central recess, or socket, 45B located in plastic tray 45. The seating of flange 44A into central socket 45B serves to both provide structural support for the plastic plate 44 (against deformity and flexing from forces exerted on plastic plate 44) and to prevent lateral movement of the plate 44 while it is rotating. The small contacting area, combined with the smooth hard plastic surfaces of plastic plate 44 and projecting ribs 45A, result in very low sliding friction between the rotating plastic plate 44 and the fixed plastic tray 45.

Figure 6:
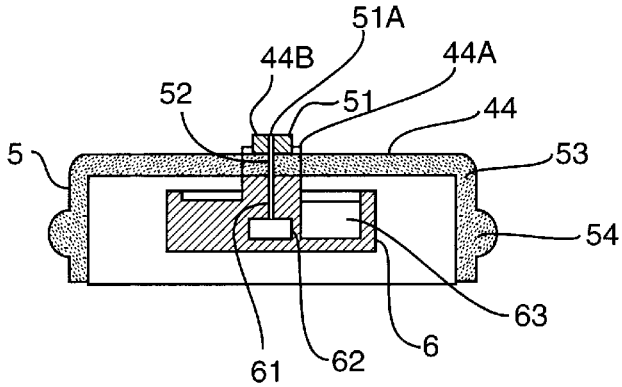
FIG. 6 is a cross-sectional view of the assembly of parts defining the passageway for the shaft of the ornamental figurine for the embodiment using the plastic plate of FIG. 3.

The provision of plastic tray 45 is an optional friction-reducing feature of the invention. Thus, FIGS. 1, 4, and 7 together show an embodiment employing the plastic tray 45, while FIGS. 5 and 6 show an embodiment without a plastic tray 45. When plastic tray 45 is not used, the plastic plate 44 is glued to the top of rubber plug 5, and the revolving base 4 is in sliding friction with the top surface of plastic plate 44 as the revolving base 4 and figurine 41 rotate.

Figure 7:
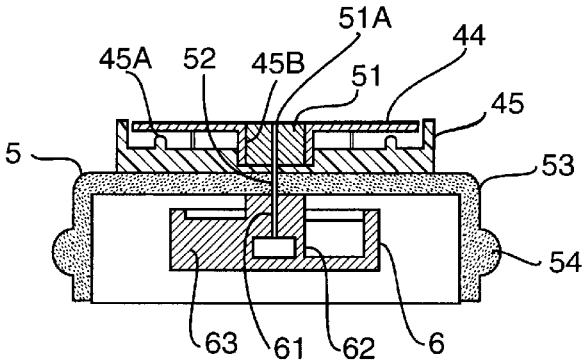
FIG. 7 is a cross-sectional view of the assembly of parts defining the passageway for the shaft of the ornamental figurine for the embodiment using the plastic plate of FIG. 3 and the plastic tray of FIG. 4.

In the embodiment of FIGS. 1, 4, and 7, the rubber plug 5 has a small sealing gasket 51 disposed on top, and a hole 52, shown best in FIG. 6. The sealing gasket 51 also has a hole 51A aligned to communicate with the hole 52 of the rubber plug 5 for the shaft 43 to fit therethrough. Shaft 43 is thus double-sealed against water leakage around the shaft 43.

The rubber plug 5 further has an annular wall 53 fitted and adhered around the inner surface of the bottom 31 of glass dome 3. In addition, the plug annular wall 53 and the bottom 31 of glass dome 3, respectively, have rubber plug annular projection 54 and glass dome annular projection 32 to mutually engage in a secure air and water tight seal to prevent water in the glass dome 3 from leaking out.

The material used to make the shaft is preferably stainless steel #304, a material highly resistant to corrosion and rust, and able to withstand high stress. The diameter of the shaft should be about 2 mm or less, and may be as small as about 0.3 mm (for very small or very light weight revolving objects), but is preferably about 1.5 mm. As materials are made stronger, it may be possible for the diameter to be less than 0.3 mm. The smaller diameter of the shaft 43 provides two significant advantages. First, it decreases the required torque to drive the shaft due to the reduction of shaft friction resistance, thereby allowing the shaft 43 to rotate smoothly. The thicker diameter shafts used by the prior art encounter a strong frictional resistance due to the greater area of shaft-to-washer contact. Consequently, the rotation of the shaft of prior art devices may be uneven and may stutter, given the limited rotational force used to power the shaft, i.e. the power provided by a music box spring mechanism.

Secondly, the smaller diameter of the shaft 43 minimizes the angular velocity of the periphery of the shaft 43 and therefore the speed of the relative motion between the periphery of the shaft 43 and the sealing gasket 51. The minimal angular velocity of the shaft 43, together with the decreased area exposed to the liquid, as well as the velocity of the liquid, combine to solve the persistent problem of leakage found in prior art rotating devices.

The sealing gasket 51 is made of a silicon or silicon rubber compound, preferably a flexible sealant material such as that usually used to make O-rings and the like. The material should have good elasticity and be highly resistant to the "aging effect" (i.e., hardening and cracking). The diameter of the hole 51A in sealing gasket 51 is of a diameter slightly less than the diameter of the steel shaft 43 so as to apply a pressure seal around shaft 43 when assembled.

The first coupling 6 has a center hole 61 for the shaft 43 to pass through and then be bent to extend into a notch 62 of the first coupling 6 to lock the shaft 43 with the first coupling 6 so as to rotate together. The first coupling 6 further has a plurality of aligned openings 63 for receiving upright bars 71 of the second coupling 7, so that the rotating musical movement 2 may drive the revolving base 4 via the coupled second coupling 7 and first coupling 6. Because the openings 63 are larger than the diameters of upright bars 71, the two coupling members 6 and 7 can be engaged and disengaged without axial contact or friction.

After the revolving device is assembled together as described above and shown in FIG. 5 (or FIG. 1 when collapsed), the winding key 21 is rotated to drive the revolving musical movement 2, which then rotates the second coupling 7. The second coupling 7 rotates the first coupling 6, which rotates the shaft 43 having two ends respectively fixed with the first coupling 6 (in notch 62) and the revolving base 4. Consequently, the revolving base 4 with the ornamental figurine 41 is rotated under power from the musical movement 2.

FIG. 6 shows the assembly of parts defining the passageway for the shaft 43 without employing a plastic tray 45, while FIG. 7 shows the assembly of parts defining the passageway for the shaft 43 using the plastic plate 44 and plastic tray 45 combination for reduced rotational friction.

From FIGS. 5 and 6, it can be seen that, without a plastic tray 45, the revolving base 4 slidably rotates on plastic plate 44 which is glued to the top of rubber plug 5. The outside diameter of sealing gasket 51 is made slightly larger than the inside diameter of opening 44B in plastic plate 44. When sealing gasket 51 is thus installed in the opening 44B, it is compressed slightly by the opening 44B and by an optional flange 44A, thereby effecting an air and water tight seal between the sealing gasket 51 and plastic plate 44. The sealing effect is enhanced by the passage of steel shaft 43 through hole 52 in rubber plug 5. Since plastic plate 44 and sealing gasket 51 are glued to the upper surface of rubber plug 5, there is no possibility for leakage through the shaft passageway.

In the embodiment of FIGS. 1 and 7, it can be seen that plastic tray 45 is glued to the top of rubber plug 5, and, as it has been stated earlier in this description, the plastic plate 44 is glued to the bottom of revolving base 4. In this embodiment, the sealing gasket 51 has a long axial shaft hole 51A the diameter of which is slightly smaller than the diameter of the steel shaft 43, so that, when assembled, peripheral sealing pressure is applied about shaft 43. Additionally, the diameter of the opening 44B in the plastic plate 44 is slightly less than the diameter of the sealing gasket 51, thereby creating a compression fit between sealing gasket 51 and plastic plate 44 when assembled. Since plastic tray 45 is glued to the top surface of rubber plug 5, there is no possibility for leakage to occur.

FIG. 7 also shows best the small area of frictional contact between the projecting ribs 45A on plastic tray 45 and the lower surface of plastic plate 44.

While only certain embodiments of the invention have been set forth above, alternative embodiments and various modifications will be apparent from the above description and the accompanying drawing to those skilled in the art. These and other alternatives are considered equivalents and within the spirit and scope of the present invention.

What is claimed is:

1. A revolving assembly for a water globe, comprising:

a water globe base having an upper open mouth for receiving a bottom of a glass dome to fit therein, said base having a bottom on which a revolving movement is fixed;

a rotatable object within said glass dome, said rotatable object having a shaft extending downwardly therefrom;

a coupler driven by said revolving movement, for coupling said revolving movement to said rotatable object to rotate said rotatable object within said glass dome;

a sealing member disposed between said coupler and said rotatable object, said sealing member having an axial hole therein water tight sealed with said shaft; and a sealing plug fitting in watertight relationship to said bottom of said glass dome, said sealing plug having an axial hole therein water tight sealed with said shaft, said sealing member and said sealing plug defining a dual sealing arrangement.

2. The revolving assembly as claimed in claim 1, wherein:

said shaft is made of stainless steel; and said sealing member is made of a flexible sealant material.

3. The revolving assembly as claimed in claim 2, wherein the diameter of said shaft is in the range of about 0.3 mm to 2 mm.

4. The revolving assembly as claimed in claim 1, comprising:

an annular flat plate attached to and coaxial with said sealing plug; and a base on said rotatable object, said base slidably rotatable on said annular flat plate.

5. The revolving assembly as claimed in claim 1, comprising:

an annular flat plate attached to and coaxial with said rotatable object; and an annular tray attached to and coaxial with said sealing plug, said annular flat plate slidably rotatable on said annular tray.

6. The revolving assembly as claimed in claim 5, wherein said annular tray comprises a plurality of arcuate thin ribs projecting toward and slidably contacting said annular flat plate.

7. The revolving assembly as claimed in claim 6, wherein said ribs are arranged in an intermittent circular pattern on said annular tray and facing said annular plate.

8. The revolving assembly as claimed in claim 4, wherein:

said annular flat plate has a central opening therein; and said sealing member is compress fit into said flat plate central opening.

9. The revolving assembly as claimed in claim 1, wherein:

said glass dome has a glass portion with an open bottom; and said sealing plug extends completely across said open bottom except for said axial hole therein through which said shaft extends.

10. A revolving assembly for a water globe, comprising:

a water globe base having an upper open mouth for receiving a bottom of a glass dome to fit therein, said base having a bottom on which a revolving movement is fixed;

a rotatable object within said glass dome, said rotatable object having a shaft extending downwardly therefrom;

a coupler driven by said revolving movement, for coupling said revolving movement to said rotatable object to rotate said rotatable object within said glass dome;

a sealing member disposed between said coupler and said rotatable object, said sealing member having an axial hole therein water tight sealed with said shaft; and a sealing plug fitting in watertight relationship to said bottom of said glass dome, said sealing plug having an axial hole therein water tight sealed with said shaft, said sealing member and said sealing plug defining a dual sealing arrangement, said sealing member glued to said sealing plug.

11. A revolving assembly for a water globe, comprising:

a water globe base having an upper open mouth for receiving a bottom of a glass dome to fit therein, said base having a bottom on which a revolving movement is fixed;

a rotatable object within said glass dome, said rotatable object having a shaft extending downwardly therefrom;

a coupler driven by said revolving movement, for coupling said revolving movement to said rotatable object to rotate said rotatable object within said glass dome;

a sealing member disposed between said coupler and said rotatable object, said sealing member having an axial hole therein water tight sealed with said shaft;

a sealing plug fitting in watertight relationship to said bottom of said glass dome, said sealing plug having an axial hole therein water tight sealed with said shaft, said sealing member and said sealing plug defining a dual sealing arrangement;

an annular flat plate attached to and coaxial with said rotatable object; and an annular tray attached to and coaxial with said sealing plug, said annular flat plate slidably rotatable on said annular tray, said sealing member glued to said annular tray.

* * * * *